US011772686B2

(12) United States Patent
Sarti et al.

(10) Patent No.: US 11,772,686 B2
(45) Date of Patent: Oct. 3, 2023

(54) TERRACE RAILWAY CAR

(71) Applicant: SpeedInnov, Paris (FR)

(72) Inventors: Christophe Sarti, Saint Médard d'Aunis (FR); Joel Hachet, Clavette (FR); Alexis Bonnet, Paris (FR); Joris Bonnesoeur, Paris (FR); Etienne Feger, Yvré l'Evêque (FR)

(73) Assignee: SpeedInnov, Paris (FR)

( * ) Notice: Subject to any disclaimer, the term of this patent is extended or adjusted under 35 U.S.C. 154(b) by 0 days.

(21) Appl. No.: 17/804,076

(22) Filed: May 25, 2022

(65) Prior Publication Data

US 2022/0281490 A1 Sep. 8, 2022

Related U.S. Application Data

(63) Continuation of application No. 16/451,429, filed on Jun. 25, 2019, now Pat. No. 11,608,090.

(30) Foreign Application Priority Data

Jun. 25, 2018 (FR) ..... 18 55637

(51) Int. Cl.
*B61D 1/06* (2006.01)
*B61D 17/10* (2006.01)
(Continued)

(52) U.S. Cl.
CPC ..... *B61D 1/06* (2013.01); *B61D 17/10* (2013.01); *B61D 23/00* (2013.01); *B61D 37/006* (2013.01)

(58) Field of Classification Search
CPC ..... B61D 23/00; B61D 17/10; B61D 1/06; B61D 1/08; B61D 1/00; B61D 1/04; B61D 1/02; B61D 37/006
See application file for complete search history.

(56) References Cited

U.S. PATENT DOCUMENTS 1,508,178 A * 9/1924 Gage ..... B62D 31/04 296/178
5,063,859 A 11/1991 Rader
(Continued)

FOREIGN PATENT DOCUMENTS

DE 10 2006 042 070 A1 3/2008
DE 10 2013 101 928 * 8/2014
(Continued)

OTHER PUBLICATIONS

French Search Report for French Application No. 1855637, dated Mar. 14, 2019 in 2 pages.
(Continued)

*Primary Examiner* — Mark T Le
(74) *Attorney, Agent, or Firm* — Knobbe, Martens, Olson & Bear, LLP

(57) ABSTRACT

A railway vehicle car includes a lower level and an upper level that are separated by an intermediate floor. The intermediate floor defines an opening emerging on the upper level and on the lower level, and also defines a bridge extending at least partially along the opening. The bridge connects a first longitudinal end and a second longitudinal end of the car on the upper level. The circulation of passengers is blocked on the lower level at least at one of the first longitudinal end and the second longitudinal end.

8 Claims, 2 Drawing Sheets

(51) Int. Cl.
*B61D 23/00* (2006.01)
*B61D 37/00* (2006.01)

(56) References Cited

U.S. PATENT DOCUMENTS

| | | | |
|---|---|---|---|
| 9,845,155 | B2 | 12/2017 | Brown et al. |
| D915,967 | S | 4/2021 | Pelletier et al. |

FOREIGN PATENT DOCUMENTS

| | | | |
|---|---|---|---|
| EP | 0625457 | A1 | 11/1994 |
| EP | 2363333 | A1 | 9/2011 |
| EP | 3293070 | A1 | 3/2018 |
| EP | 3293071 | A1 | 3/2018 |
| GB | 224 461 | A | 11/1924 |

OTHER PUBLICATIONS

YouTube picture (Nov. 2, 2011)—A room with an above opening and bridge (Year: 2011).

* cited by examiner

TERRACE RAILWAY CAR

CROSS-REFERENCE TO RELATED APPLICATIONS

This application is a continuation of U.S. application Ser. No. 16/451,429, filed on Jun. 25, 2019, which claims priority to French Patent Application No. 18 55637, filed Jun. 25, 2018, which are hereby incorporated by reference in their entirety.

FIELD OF THE INVENTION

The present invention relates to a railway vehicle car, comprising a lower level and an upper level that are separated by an intermediate floor, the intermediate floor defining an opening emerging on the upper level and on the lower level, the intermediate floor also defining a bridge extending at least partially along the opening, the bridge connecting a first longitudinal end and a second longitudinal end of the car on the upper level.

BACKGROUND OF THE INVENTION

In the field of railway vehicles, it is known to produce cars with two levels in order to increase the useful surface of the railway vehicle for a given length. However, the division of such a car into two superimposed levels is often done to the detriment of the height below the ceiling, which can give travelers an impression of confinement.

In the case of railway vehicles with two levels, it is possible to improve the esthetics of the car by arranging an opening in the intermediate floor, connecting the lower level and the upper level. The large free height above the opening creates a pleasant "cathedral effect" for travelers.

In the cars of the state of the art, the opening separating the upper level into two separate parts, the circulation of travelers through the car is done at the lower level, and the car comprises a staircase allowing access to the upper level at each of its ends.

This arrangement of the car with two levels is not fully satisfactory. Indeed, due to the need to leave a passage passing through the lower level, the usable surface on the lower level is reduced. In particular, travelers have less space to settle in, and it is difficult to move around with bulky luggage or with distribution trolleys for on-board personnel.

SUMMARY OF THE INVENTION

Thus, one aim of the invention is to provide a car with two levels benefiting from a "cathedral effect", while having large useful surfaces on the lower level and the upper level, for travelers and personnel.

To that end, the invention relates to a car of the aforementioned type, wherein the circulation of passengers is blocked on the lower level at least at one of the first longitudinal end and the second longitudinal end.

According to specific embodiments, the car according to the invention includes one or more of the following features, considered alone or according to any technically possible combination(s):

- the opening has a length greater than or equal to one quarter of a length of the lower level and a width greater than or equal to half of a width of the lower level;

- the car is intended for dining for travelers, the lower level comprising a preparation area and a dining area, the preparation area extending continuously between a first side wall and a second side wall of the car, over an entire width of the lower level;
- the preparation area is separated from the dining area by a counter extending continuously from the first side wall to the second side wall;
- the car has a single staircase connecting the upper level and the dining area;
- the staircase has a width greater than or equal to one third of the width of the lower level;
- the dining area includes dining seats aligned along the first side wall or the second side wall;
- the upper level includes at least one row of seats extending along the first side wall and an aisle extending over the bridge along the opening;
- the car includes an elevator able to move distribution trolleys between the preparation area and the upper level; and
- the first side wall and the second side wall each include an access opening emerging on the outside of the car and on the preparation area.

BRIEF DESCRIPTION OF THE DRAWINGS

The invention will be better understood upon reading the following description, provided solely as an example and done in reference to the appended drawings, in which.

DETAILED DESCRIPTION OF THE PREFERRED EMBODIMENTS

Figure 1:
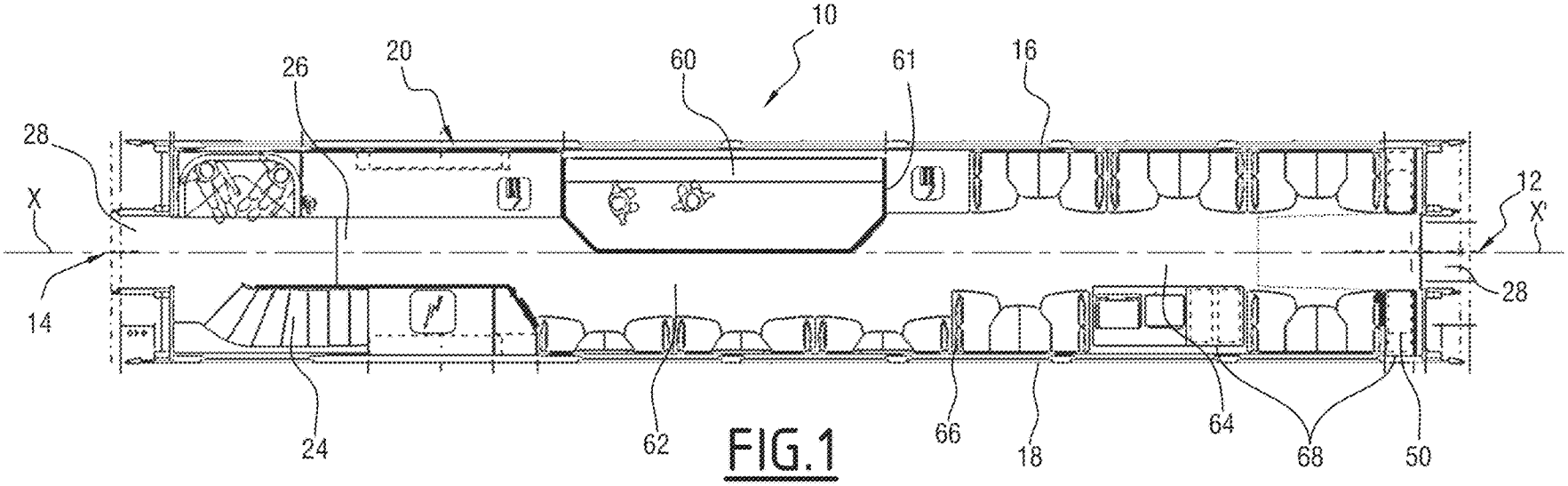
FIG. 1 is a top view of the upper level of the car according to a first embodiment of the invention.
Figure 2:
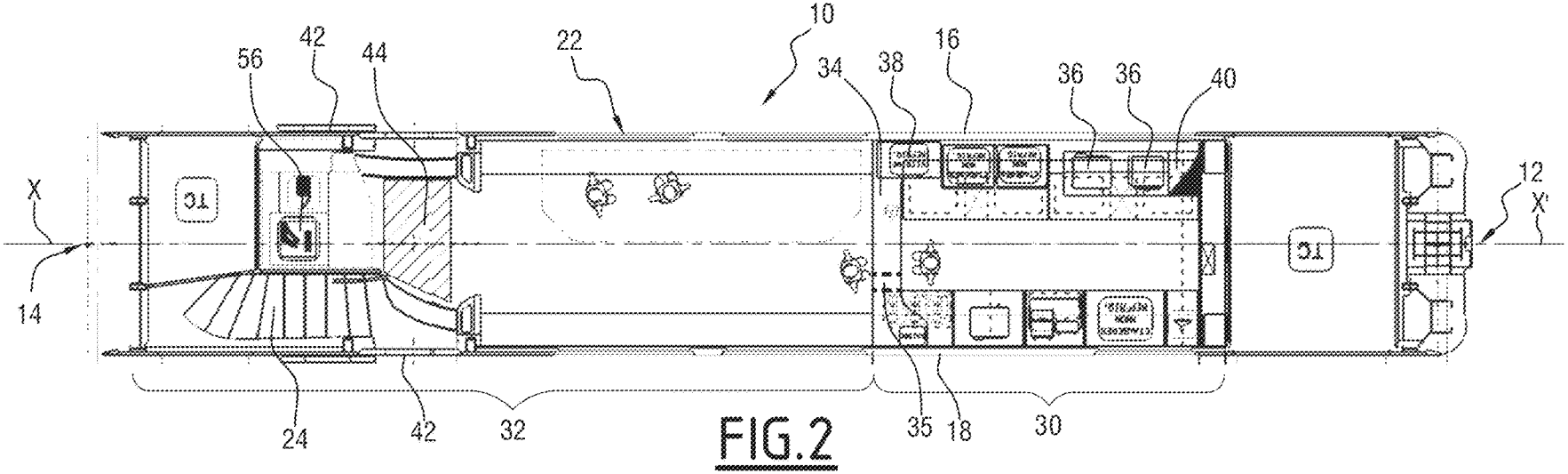
FIG. 2 is a top view of the lower level of the car of FIG. 1.

A railway vehicle car 10 according to a first embodiment is shown in FIGS. 1 and 2. The car is a restaurant car dedicated to accommodating passengers wishing to acquire products, such as beverages and/or food, as well as to offer a space suitable for consuming products in a pleasant context.

The car 10 extends along a longitudinal axis X-X' between a first end 12 and a second end 14. The car 10 is delimited laterally by a first side wall 16 and a second side wall 18, which are substantially planar and parallel to one another, extending on either side of the longitudinal axis X-X'.

The car 10 is a car with two levels, and therefore includes an upper level 20 visible in FIG. 1 and a lower level 22 visible in FIG. 2.

The upper level 20 and the lower level 22 have substantially identical lengths, from the first end 12 to the second end 14, and substantially identical widths, from the first side wall 16 to the second side wall 18.

The car 10 also includes a single staircase 24 connecting the upper level 20 and the lower level 22, and an intermediate floor 26 separating the upper level 20 from the lower level 22.

The car 10 communicates with preceding and following cars of the train by two passages 28, located at the first end 12 and the second end 14, and both emerging on the upper level 20.

The circulation of passengers is blocked at the lower level 22 at least at one of the first longitudinal end 12 and the second longitudinal end 14, and in particular at the first longitudinal end 12 and the second longitudinal end 14.

The circulation from the car 10 toward the preceding and following cars is provided at the upper level 20. Thus, it is not necessary to allow crossing of the lower level 22 to travelers, which makes it possible to lay out the lower level 22 more efficiently.

The lower level 22 comprises a preparation area 30 and a dining area 32, which are separated by a counter 34.

The preparation area 30 and the dining area 32 both extend continuously from the first side wall 16 to the second side wall 18. Likewise, the counter 34 extends continuously from the first side wall 16 to the second side wall 18.

Thus, the preparation area 30 and the dining area 32 each extend over the entire width of the lower level 22.

The preparation area 30 is intended for preparation by the on-board personnel of products that are consumable by the travelers, and is therefore reserved for the on-board personnel during normal times.

The layout of the preparation area 30 over the entire width of the lower level 22 makes it possible to increase the space available to the on-board personnel to pass one another and move around during product distribution to the travelers.

The counter 34 allows the on-board personnel located in the preparation area 30 to distribute products to the travelers located in the dining area 32. The counter 34 extends over the entire width of the lower level 22, which makes distribution easier.

The counter 34 for example has a door 35 allowing the on-board personnel to move between the preparation area 30 and the dining area 32. Alternatively, the counter 34 has a retractable portion.

The preparation area 30 thus comprises kitchen devices 36 usable by the personnel to prepare the food and beverages. The preparation area 30 also comprises a refrigerated storage system 38, suitable for storing the food under good conditions.

Advantageously, the refrigerated storage system 38 comprises at least one refrigerated rolling base 40, suitable for containing the foods and storing them at a low temperature, while being easily movable. This in particular makes it possible to facilitate the supply of the car 10 between trips, while moving the refrigerated rolling bases 40 directly.

The first side wall 16 and the second side wall 18 each define an access opening 42 emerging on the one hand on the dining area 32 or the preparation area 30 and on the other hand on the outside of the car 10. In this embodiment, the access opening 42 emerges on the dining area 32 and on the outside of the car 10. The supply of the car 10 is done through the openings 42, which are thus located on both sides of the car 10, which makes it possible to adapt to platforms located on either side.

Advantageously, the car 10 comprises a lift 44 actuating a platform. In this embodiment, the lift 44 is located in the dining area 32, near the staircase 24 and openings 42. The lift 44 is suitable for varying a height of the platform. The platform can thus be moved from the height of the rest of the preparation area to the height of the platform if the latter is different. This makes it possible to further facilitate the supply by lifting heavy loads mounted on wheels, for example the refrigerated rolling bases 40.

The dining area further includes at least one automatic distributor 56, for example located below the staircase 24, making it possible to facilitate product distribution.

The floor 26 defines an opening 60 emerging on the upper level 20 and on the lower level 22, above the dining area 32. The opening 60 gives the dining area a pleasant appearance, which has an open appearance owing to a large free height above the travelers located therein.

Advantageously, the opening 60 has a length greater than or equal to one quarter of a length of the lower level 22 and a width greater than or equal to half of a width of the lower level 22.

The large dimensions of the opening 60 make it possible in large part to reproduce the "cathedral effect", without the opening 60 taking up the entire width of the upper level 20.

The opening 60 is provided with a railing 61 that extends along the periphery of the opening 60.

The floor 26 also defines a bridge 62 extending between the opening 60 and the second side wall 18. The bridge 62 allows the floor 26 to connect the first end 12 and the second end 14 continuously, at the upper level 20.

The upper level 20 includes an aisle 64 connecting the two passages 28, suitable for the circulation of travelers, on-board personnel and distribution trolleys 50, and at least one row of seats 66 extending along the first side wall 16. The aisle 64 and the row of seats 66 in particular extend over the bridge 62.

The upper level advantageously includes storage locations 68 for the distribution trolleys 50, for example located along the aisle 64, against the second side wall 18.

The distribution trolleys 50 are intended to allow the distribution of products by the on-board personnel on the upper level 20, as well as the other cars that are accessed by the passages 28 emerging on the upper level 20.

The staircase 24 connects the upper level 20 and the dining area 32. The staircase 24 extends substantially longitudinally, along the second side wall 18. It emerges at an upper end, allowing travelers to access the lower level 22 from the upper level 20, and vice versa.

The service of the dining area 32 by a single staircase rather than by two staircases located at the first end 12 and the second end 14 makes it possible to reduce the total occupied space and to dedicate more space to the staircase 24.

Figure 3:
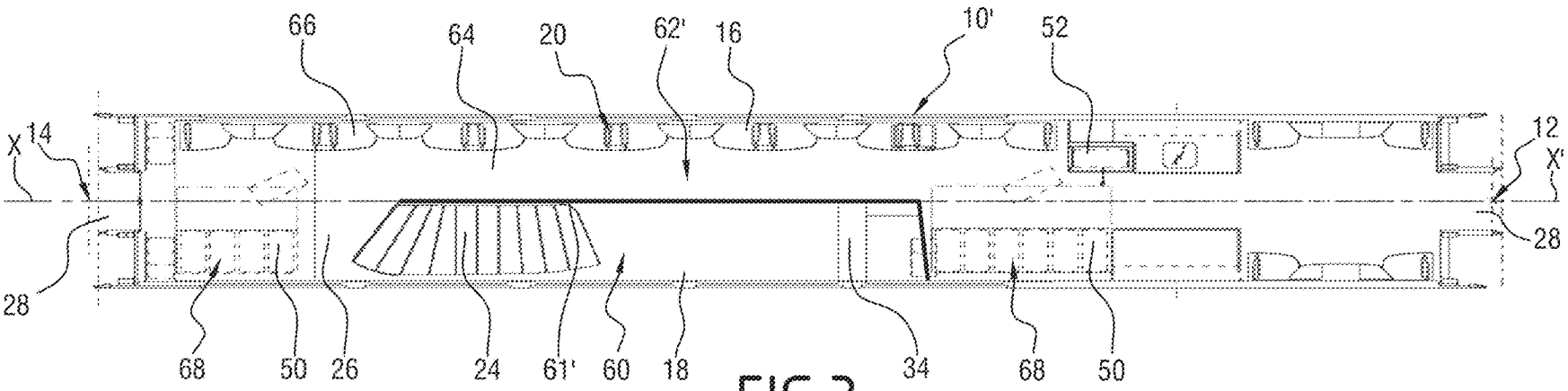
FIG. 3 is a top view of the upper level of the car according to a second embodiment of the invention.
Figure 4:
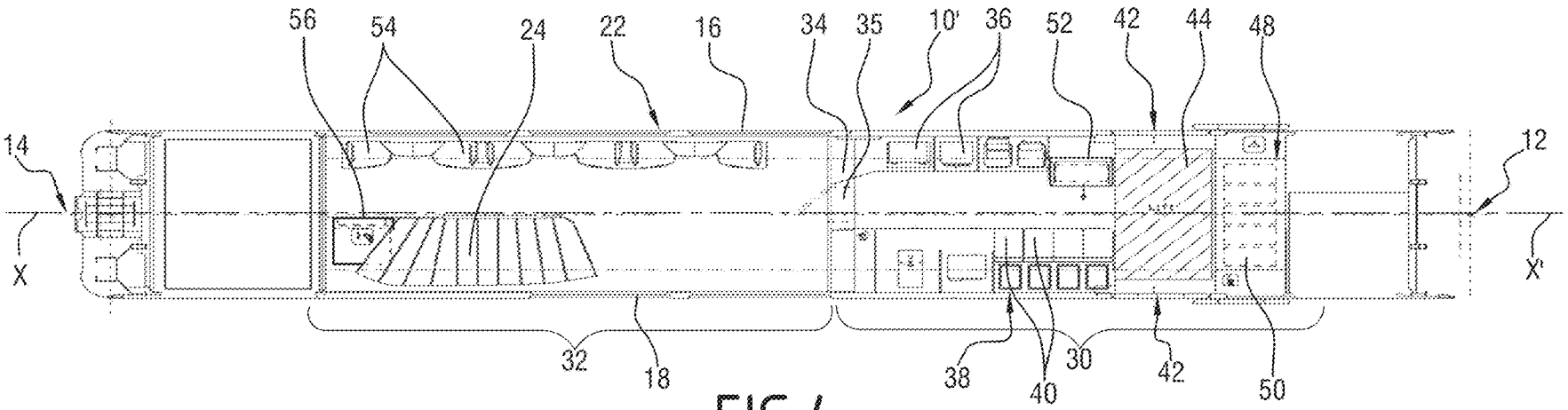
FIG. 4 is a top view of the lower level of the car of FIG. 3.

A car 10' according to a second embodiment of the invention is shown in FIGS. 3 and 4. Only the features differing from the features of the car 10 will be described hereinafter.

In this embodiment, the openings 42 emerge on the preparation area 30 and the outside of the car 10', while the lift 44 is located in the preparation area 30, between the openings 42.

The preparation area 30 further comprises storage spaces 48 for a plurality of distribution trolleys 50, as well as an elevator 52 suitable for moving the distribution trolleys 50 between the lower level 22 and the upper level 20.

The elevator 52 allows the on-board personnel to reload the distribution trolleys 50 in the preparation area 30, and next to move them to the upper level 20 in order to perform the distribution.

Advantageously, the dining area 32 includes dining seats 54 aligned along the first side wall 16, allowing the travelers to sit down to consume the products. Also advantageously, the dining area 32 also includes tables located near the dining seats 54 in order to facilitate consumption.

The floor 26 defines a bridge 62' extending between the opening 60 and the first side wall 16.

The opening 60 is provided with a railing 61' that extends along the periphery of the opening 60', to the exclusion of the edge on which the staircase 24 emerges.

The staircase 24 has a large width, which facilitates the movements of the travelers between the dining area 32 and the upper level 20, in particular allowing travelers with luggage to pass one another.

Advantageously, the staircase 24 has a width greater than or equal to one third of the width of the lower level 22.

The layout of the cars 10 and 10' is particularly advantageous in the restaurant car case. Indeed, the separation of the lower level 22 into a preparation area 30 and a dining area 32 each occupying the entire width of the level makes it possible to facilitate movements and improves the comfort of the on-board personnel and travelers.

In a variant, the car 10 is not a restaurant car, but a standard car. The dining 32 and preparation 30 areas are then replaced by different functional areas, for example areas including traveler seats, or children's play areas or multimedia areas. The circulation of passengers only at the upper level 20 makes it possible to have a more efficient layout of the lower level 22, which differs depending on the nature of the functional areas.

What is claimed is:

1. A railway vehicle car, comprising a lower level and an upper level that are separated by an intermediate floor, wherein the intermediate floor defines an opening emerging on the upper level and on the lower level, wherein the intermediate floor also defines a bridge extending at least partially along the opening and connecting a first longitudinal end and a second longitudinal end of the car on the upper level, wherein any circulation of passengers is blocked on the lower level at least at one of the first longitudinal end and the second longitudinal end, wherein the car is intended for dining for travelers, the lower level comprising a preparation area and a dining area, the preparation area extending continuously between a first side wall and a second side wall of the car, over an entire width of the lower level, wherein the opening emerges above the dining area, wherein the car comprises at least one staircase connecting the upper level and the dining area and emerging into the opening, wherein the opening has a width greater than or equal to half of a width of the lower level over a majority of the length of the opening, and is delimited on one of the sides of the opening by the bridge and on another side by a first side wall of the car, wherein the first side wall and the second side wall each include an access opening emerging on the outside of the car and on the preparation area, and wherein the car comprises a lift located in the preparation area, between the access openings.

2. The car according to claim 1, wherein the length of the opening is greater than or equal to one quarter of a length of the lower level.

3. The car according to claim 1, wherein the preparation area is separated from the dining area by a counter extending continuously from the first side wall to the second side wall.

4. The car according to claim 1, including a single staircase connecting the upper level and the dining area.

5. The car according to claim 4, wherein the staircase has a width greater than or equal to one third of the width of the lower level.

6. The car according to claim 1, wherein the dining area includes dining seats aligned along the first side wall or the second side wall.

7. The car according to claim 1, wherein the upper level includes at least one row of seats extending along the first side wall and an aisle extending over the bridge along the opening.

8. The car according to claim 1, wherein the lift includes an elevator able to move distribution trolleys between the preparation area and the upper level.

* * * * *